US008248325B2

(12) United States Patent
Danstrom

(10) Patent No.: US 8,248,325 B2
(45) **Date of Patent: *Aug. 21, 2012**

(54) DRIVE CIRCUIT

(75) Inventor: Eric Danstrom, Palatine, IL (US)

(73) Assignee: STMicroelectronics, Inc., Coppell, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/424,481

(22) Filed: Mar. 20, 2012

(65) Prior Publication Data

US 2012/0176065 A1 Jul. 12, 2012

Related U.S. Application Data

(63) Continuation of application No. 11/100,044, filed on Apr. 6, 2005.

(51) Int. Cl.
*G09G 3/14* (2006.01)

(52) U.S. Cl. ..... 345/46; 345/34; 345/211

(58) Field of Classification Search ..... 345/34, 345/46, 211

See application file for complete search history.

(56) References Cited

U.S. PATENT DOCUMENTS

| | | | |
|---|---|---|---|
| 4,099,171 | A | 7/1978 | Meyer |
| 5,633,651 | A | 5/1997 | Carvajal et al. |
| 2006/0055687 | A1 | 3/2006 | Sheu et al. |
| 2006/0109205 | A1 | 5/2006 | Deng |
| 2006/0227070 | A1 | 10/2006 | Danstrom |

*Primary Examiner* — Kevin M Nguyen
*Assistant Examiner* — Cory Almeida
(74) *Attorney, Agent, or Firm* — Gardere Wynne Sewell LLP

(57) ABSTRACT

A plurality of resistive paths are coupled in parallel to a common node. A high side driver is operable responsive to first control signals to selectively supply current to certain ones of the resistive paths. A low side driver, including a plurality of selectively actuated current sink paths, is provided to sink current from the common node. A control logic circuit actuates a current sink path within the low side driver for each resistive path that is selectively supplied current by the high side driver. A substantially constant low side voltage drop through these sink paths is provided regardless of the number of resistive paths that are supplied current by the high side driver. A switched high side and low side configuration operating in an analogous way is also disclosed.

20 Claims, 3 Drawing Sheets

DRIVE CIRCUIT

CROSS-REFERENCE TO RELATED APPLICATION

This application is a continuation of U.S. application for patent Ser. No. 11/100,044 filed Apr. 6, 2005, the disclosure of which is hereby incorporated by reference.

BACKGROUND

1. Technical Field

The present invention relates to drive circuits, for example drive circuits for light emitting diodes, and more particularly to a drive circuit for an array of light emitting diodes. The drive circuit is configured to maintain substantially constant brightness regardless of the number of light emitting diodes within the array which have been turned on.

2. Description of Related Art

Reference is now made to FIG. 1 wherein there is shown a light emitting diode (LED) array 10 and drive circuit 12 in accordance with the prior art. The LED array 10 is comprised of an N×M array of individual light emitting diodes 14. The reference M refers to a number of rows in the array 10, and more generally refers to a number of grids G of LEDs 14 which are included in the array. The reference N refers to a number of columns in the array 10, and more generally refers to a number of segments S (or individual LEDs 14) within each row or grid G of the array. As an example, the array 10 may include thirteen segments S (N=13) (or LEDs 14) in each of seven included grids G (M=7). The specific configuration with respect to only the first grid G (M=1) of the array 10 and its N LEDs 14 is shown in order to simplify the illustration. Each LED 14 includes a series connected current limiting resistor 16 in accordance with standard LED circuit design.

The LEDs 14 of the array 10 are connected in a common cathode configuration. Thus, within each grid G, the N included LEDs 14 all have their cathode terminals connected together. The common cathode connection node 18 for the LEDs 14 in each grid G is connected to a low side driver 20 comprised of, for example, an MOS transistor 22 (shown here as an n-channel device) having its source/drain terminals connected between a ground reference voltage 24 and the node 18. Thus, one low side driver 20 is provided for each grid G. A gate terminal of the transistor 22 is connected to receive a grid control signal output from a grid output latch circuit 26. This grid control signal in effect selects, through the corresponding low side driver 20, which one of the M grids G is to be actuated at a given time (and thus allow for segment S LED 14 illumination within that selected grid).

All of the LEDs 14, through their associated current limiting resistors 16, are connected to a high side driver 30 comprised of, for example, N in number MOS transistors 32 (shown here as n-channel devices). Each included high side driver 30 transistor 32 has its source/drain terminals connected between a positive reference voltage 34 and the current limiting resistors 16 associated with one LED 14 in each of the M grids G. Thus, a certain transistor 32 of the high side driver 30 is shared among and between M LEDs 14 in the included grids. For example, a first transistor 32(1) has its drain terminal connected to each of the resistors 16(1) for the LEDs 14(1) in each of the M grids G. Similarly, a second transistor 32(2) has its drain terminal connected to the resistors 16(2) for the LEDs 14(2) in each of the M grids G. This connection architecture is repeated across the N included LED 14 segments S of the M grids G within the array 10 and is schematically represented through the illustrated high side driver bus 46. A gate terminal of each transistor 32 is connected to receive a segment control signal output from a segment output latch circuit 36. These segment control signals in effect select which ones of the N LED 14 segments S (within the grid control signal selected grid G) is to be actuated. The segment control signals output from the segment output latch circuit 36 may be amplified and/or buffered and/or inverted by circuit 38 if desired/needed prior to application to the gate terminals of the transistors 32 of the high side driver 30.

It is important that the driver 12 for the array 10 be capable of maintaining a constant brightness across the array of LEDs. To achieve this goal, the voltage applied across an LED 14 and its associated series connected current limiting resistor 16 must be constant regardless of the number of other LEDs that have also been turned on. In the typical common cathode array architecture shown in FIG. 1, each high side driver 30 transistor 32 drives one LED 14 (within the selected grid G), and the low side driver 20 for that selected grid must sink the sum of the currents for all of the LEDs 14 within the grid which have been actuated. With N LEDs 14 per grid G, the low side driver 20 with the common cathode connection at node 18 may have to sink current for any of 1 to N LEDs 14. If the low side driver 20 transistor 22 is a MOS transistor, the voltage drop across this low side output would equal the sunk current from the actuated LEDs 14 times the on resistance of MOS device. In the FIG. 1 configuration for the array 10 and driver 12, a significant difference in voltage drop can occur, where this drop is dependent on the number of actuated LEDs 14 in the selected grid G. For example, assume that the on resistance of the transistor 22 is 1 Ohm, and the current per actuated LED 14 is 50 mA. With only one LED 14 actuated in the selected grid G, the voltage drop across the low side driver 20 would be 50 mV. However, with N=13 LEDs 14 actuated in the selected grid G, the voltage drop across the low side driver 20 would be 650 mV. This 600 mV difference between having one LED actuated and having thirteen LEDs actuated in the selected grid G could cause a noticeable difference in brightness between grids G having different numbers of actuated LEDs 14.

A need accordingly exists for an LED arrays driver to address the foregoing problem and maintain substantially constant brightness among and between LEDs across the grids of the array.

SUMMARY

In an embodiment, a drive circuit comprises: a high side driver operable responsive to first control signals to selectively actuate certain ones of a plurality of current source paths coupled in parallel between a first voltage reference node and a common node; and a low side driver operable response to second control signals to selectively actuate certain ones of a plurality of current sink paths coupled in parallel between the common node and a second voltage reference node; wherein said second control signals are generated in response to said first control signals so that a constant voltage drop from the common node to the second voltage reference node is maintained regardless of how many of the plurality of current source paths are selectively actuated by the high side driver.

In an embodiment, a drive circuit comprising: a high side driver operable to selectively supply current to a plurality of resistive paths coupled in parallel with each other between a first voltage supply node and a common node; a low side driver operable to sink current from the common node through a plurality of selectively actuated current sink paths coupled in parallel with each other between the common node and a second voltage supply node; and a control circuit operable to actuate plural ones of the selectively actuated current sink paths equal in number to the plurality of resistive paths which are selectively supplied current by the high side driver.

In accordance with an embodiment, any of the foregoing embodiments could alternatively be implemented with the configuration and functional operations of the high and low side drivers switched.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION OF THE DRAWINGS

Figure 2:
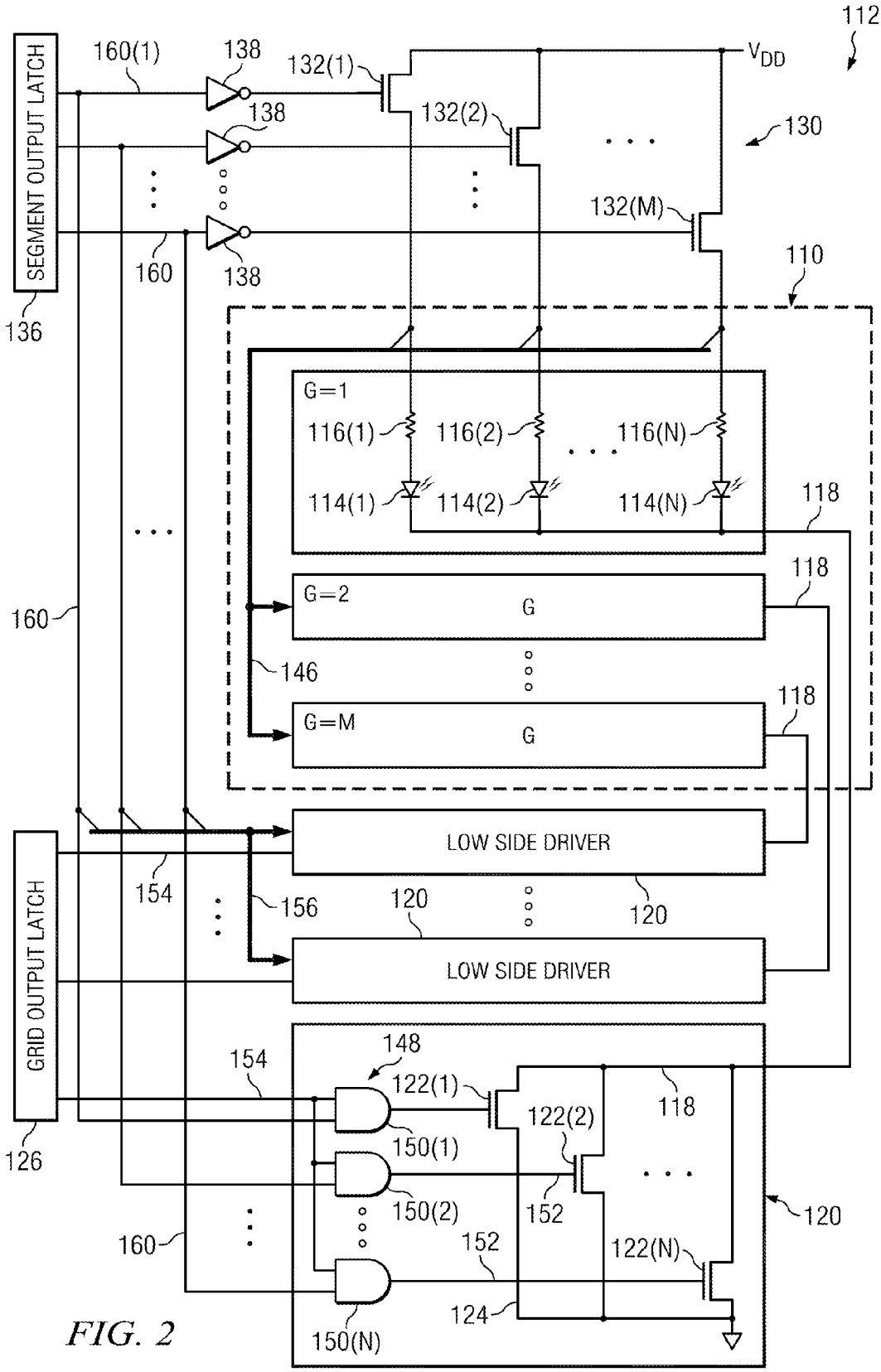
FIG. 2 is a light emitting diode (LED) array and drive circuit in accordance with an embodiment.

Reference is now made to FIG. 2 wherein there is shown a light emitting diode (LED) array 110 and drive circuit 112 in accordance with an embodiment. The LED array 110 is comprised of an N×M array of individual light emitting diodes 114. The reference M refers to a number of rows in the array 110, and more generally refers to a number of grids G which are included in the array. The reference N refers to a number of columns in the array 110, and more generally refers to a number of segments S (or individual LEDs 114) within each row or grid G of the array. As an example, the array 110 may include thirteen segments S (N=13) (or LEDs 114) in each of seven included grids G (M=7). The specific configuration with respect to only the first grid G (M=1) of the array 110 and its N LEDs 114 is shown in order to simplify the illustration. Each LED 114 includes a series connected current limiting resistor 116 in accordance with standard LED circuit design.

All of the LEDs 114, through their associated current limiting resistors 16, are connected to a high side driver 130 comprised of, for example, N in number MOS transistors 132 (shown here as n-channel devices). Each included high side driver 130 transistor 132 has its source/drain terminals connected between a positive reference voltage 134 and the current limiting resistors 116 associated with one LED 114 in each of the M grids G. Thus, a certain transistor 132 of the high side driver 130 is shared among and between M LEDs 114 in the included grids. For example, a first transistor 132(1) has its drain terminal connected to each of the resistors 116(1) for the LEDs 114(1) in each of the M grids G. Similarly, a second transistor 132(2) has its drain terminal connected to the resistors 116(2) for the LEDs 114(2) in each of the M grids G. This connection architecture is repeated across the N included LED 114 segments S of the M grids G within the array 110 and is schematically represented through the illustrated high side driver bus 146. A gate terminal of each transistor 132 is connected to receive a segment control signal 160 output from a segment output latch circuit 136. These segment control signals in effect select which ones of the N LED 114 segments S (within a selected grid G) is to be actuated. The segment control signals output from the segment output latch circuit 136 may be amplified and/or buffered and/or inverted by circuit 138 (comprising, for example, a logic inverter) if desired prior to application to the gate terminals of the transistors 132 of the high side driver 130.

Figure 1:
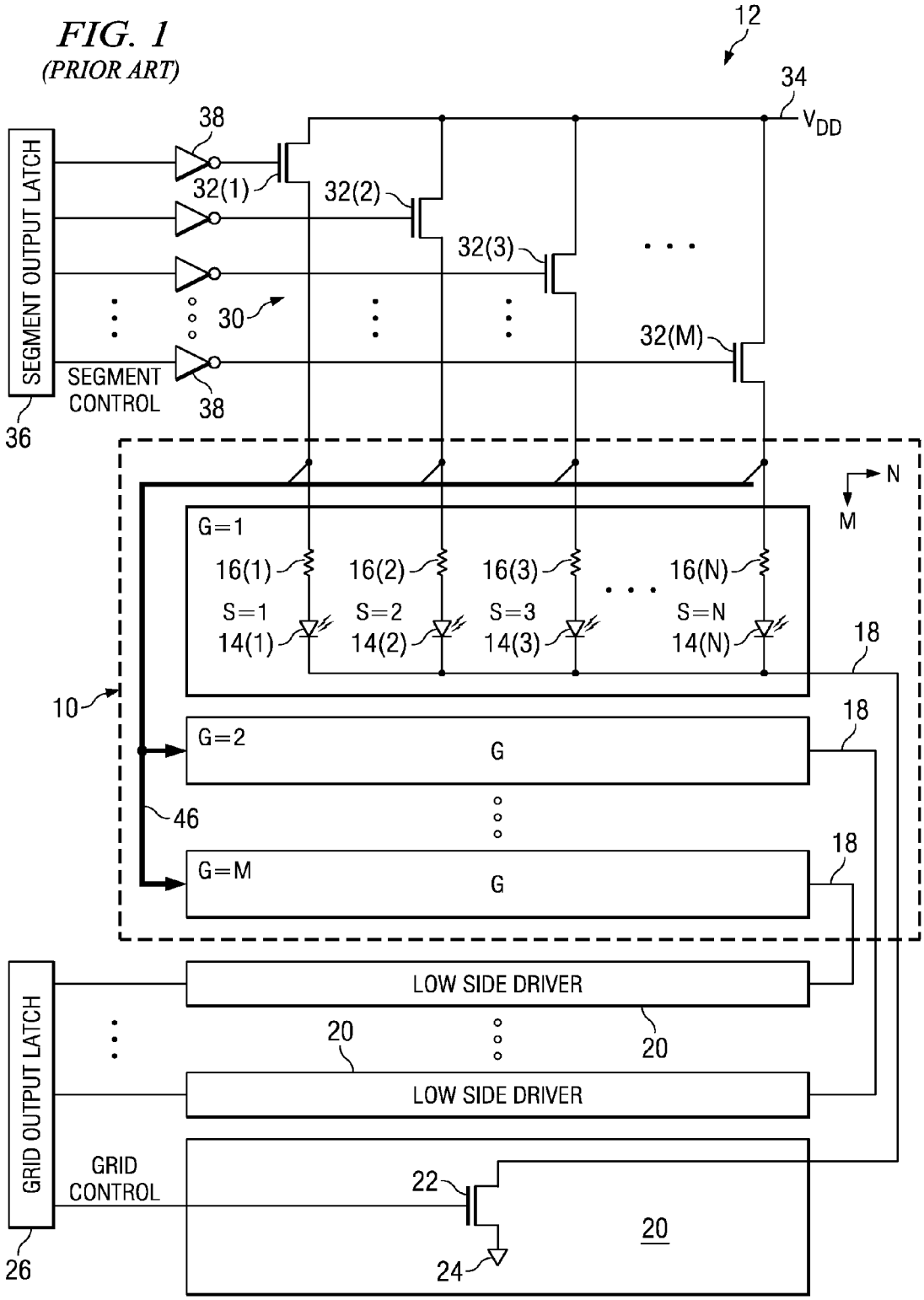
FIG. 1 (PRIOR ART)
FIG. 1 is a light emitting diode (LED) array and drive circuit in accordance with the prior art.

The LEDs 114 of the array 110 are connected in a common cathode configuration. Thus, within each grid G, the N included LEDs 114 all have their cathode terminals connected together. The common cathode connection node 118 for the LEDs 114 in each grid G is connected to a low side driver 120. The low side driver 120 differs from the driver 20 of FIG. 1 in that it is comprised of N in number MOS transistors 122 (shown here as n-channel devices) each having their source/drain terminals connected between a ground reference voltage 124 and the node 118. A gate terminal of each transistor 122 is connected to receive a signal output from a logic circuit 148 comprised of N logic gates 150 (for example, AND gates). Each logic gate 150 generates a signal 152 which is applied to a corresponding one of the transistors 122. Thus, for example, logic gate 150(1) supplies the signal 152 to the gate terminal of corresponding transistor 122(1). Responsive to the signal 152, the transistor 122 turns on and sinks current from the node 118 to ground 124.

The logic circuit 148 functions to control how many of the transistors are turned on at any given time. The logic circuit 148 for the driver 120 receives a grid control signal 154 output from a grid output latch circuit 126. This grid control signal 154 in effect selects, through the low side driver 120, which one of the M grids G is to be actuated at a given time (and thus allow for segment S LED 114 illumination within that selected grid). This grid control signal 154 is applied as an input to each of the logic gates 150 within the logic circuit 148 of the driver 120. The logic circuit 148 for the driver 120 further receives each of the segment control signals 160 output from the segment output latch circuit 136. These segment control signals are individually applied as an input to a corresponding one of the logic gates 150 within the logic circuit 148 of the driver 120. Thus, a first segment control signal 160(1) is applied to a first one of the logic gates 150(1). This application of signals 160 is repeated across the M included drivers 120 associated with the M grids G within the array 110 and is schematically represented through the illustrated low side driver bus 156.

The driver 112 for the array 110 operates as follows. Through the grid output latch 126, a certain one of the grids G within the array 110 is selected for actuation. Through the segment output latch 136 a certain one or more of the segments S (LEDs 114) within that selected grid are selected for actuation. The signals 160 for those selected segments S are applied to the transistors 132 of the high side driver 130 which then turn on and allow current to flow through the selected LEDs 114 to the node 118. The signal 154 for the selected grid G is applied to each of the logic gates 150 of the logic circuit 148 within the low side driver 120 associated with the selected grid. The logic circuit 148 further receives the segment control signals 160. These segment control signals are individually applied to corresponding logic gates 150 of the logic circuit 148. Where the segment control signal 160 is active (in this example, active high) and the grid control signal 154 is also active (again, in this example, active high), the logic gate 150 associated with that segment control signal sets the signal 152 and turns on the associated transistor 122 of the low side driver 120 to provide an actuated path for sinking current from the node 118.

As there is a transistor 122 in the low side driver 120 for the selected grid G corresponding to a transistor 132 in the high side driver 130 for a selected segment S, a current sinking path in the low side driver is actuated by the logic circuit 148 for each actuated segment in the selected grid. If the drain-to-source on resistance of the transistors 122 of the low side driver 120 were matched relatively well, as can be accomplished through careful component choice and/or integrated circuit fabrication, the low side driver essentially comprises a composite of N identical transistors (where N is equal to the number of LEDs 114 and high side driver transistors 132). By using the logic circuit 148 to turn on a number of the low side transistors 122 that is equal to the number of actuated high side transistors 132, the sinking current at node 118 is split and the voltage drop is essentially constant among and between the included grids no matter how many of the segments S (LEDs 114) have been turned on. With a constant voltage drop achieved, the brightness of the LEDs 114 will be substantially constant, and with matching identical transistors as described above the brightness will be equal, regardless of segment S actuation across the included grids G.

Although a logic circuit 148 including AND gates 150 is illustrated in FIG. 2, it will be understood by those skilled in the art that the logic circuit 148 may comprise any type of logic gate or logic configuration so long as it achieves the goal of logically combining the segment control signals 160 and the grid control signal 154 to control the sinking of current from node 118 with a constant voltage drop regardless of the number of actuated segments S. In this regard, it will further be understood that the low side driver 120 need not have a configuration including a plurality of separately controllable current paths through transistors 122, but rather may comprise any suitable circuit capable of sinking variable amounts of current with a constant voltage drop (for example, using a controllable current source/sink).

Although FIG. 2 illustrates a circuit configuration using n-channel MOS transistors, it will be understood that the circuit could alternatively be designed to utilize p-channel MOS transistors. Additionally, bi-polar transistors could be used for the circuit as well.

FIG. 2 illustrates an implementation using M grids and N segments. It will be understood that M and N can comprise any positive integer value.

The resistances 116 can comprise either integrated resistors (i.e., integrated with the transistors and other circuitry shown in FIG. 2) or external resistors (i.e., off-chip from the integrated transistors and other circuitry shown in FIG. 2).

Figure 3:
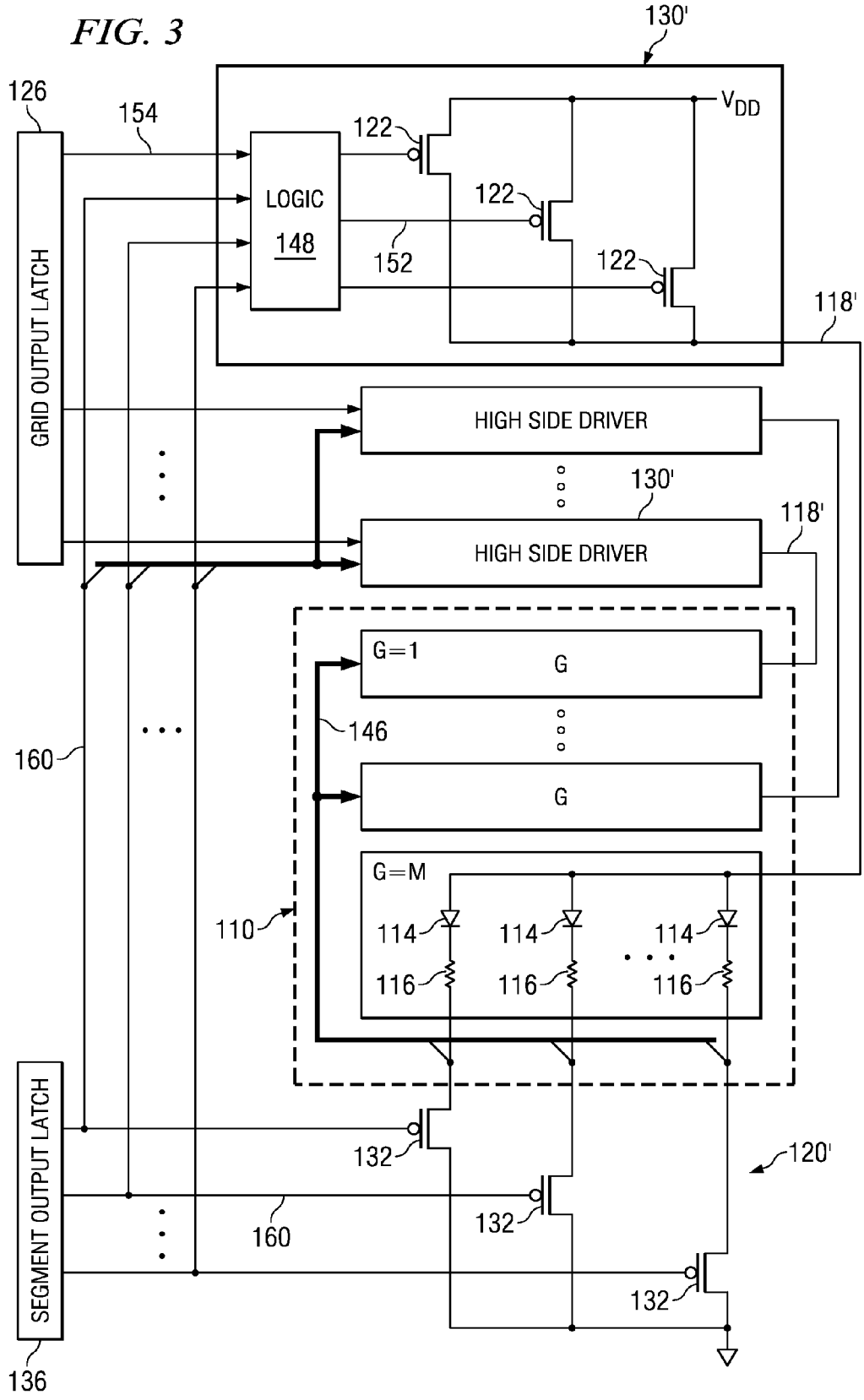
FIG. 3 is a light emitting diode (LED) array and drive circuit in accordance with an embodiment.

Reference is now made to FIG. 3 wherein there is shown an implementation using a common anode configuration for the LED array 110. In the common anode configuration, within each grid G, the N included LEDs 114 all have their anode terminals connected together. The common anode connection node 118' for the LEDs 114 in each grid G is connected to a high side driver 130'. The high side driver 130' has a configuration similar to the low side driver 120 of FIG. 2 and preferably utilizes p-channel transistors 122' whose sources are connected to Vdd. The cathodes of each LED 114 are connected to a current limiting resistor 116 in accordance with standard LED circuit design. The resistors 116 are connected to a low side driver 120'. The low side driver 120' has a configuration similar to the high side driver 130 of FIG. 2 and preferably utilizes p-channel transistors 132' whose drains are connected to ground GND and whose sources are connected to corresponding current limiting resistors 116. The grid output latch 126 includes outputs 154 coupled to individual ones of the high side drivers 130' to make grid G selections. The segment output latch 136 includes outputs 160 coupled to the gates of transistors 132' in the low side driver 120' in order to make segment S selections. The outputs 160 are further supplied to each of the high side drivers 130'. Logic circuitry 148 in each high side driver 130' logically combines the outputs 160 with the output 154 for that particular driver in order to generate the control signal 152 that is applied to the gates of the transistors 122 and thus actuate a number of current source paths which equals the number of actuated segments S. Operation of the embodiment of FIG. 3 is therefore analogous to that of FIG. 2.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A drive circuit, comprising:

a high side driver operable responsive to first control signals to selectively actuate certain ones of a plurality of current source paths coupled in parallel between a first voltage reference node and a common node; and a low side driver operable responsive to second control signals to selectively actuate certain ones of a plurality of current sink paths coupled in parallel between the common node and a second voltage reference node;

wherein said second control signals are generated in response to said first control signals so that a constant voltage drop between the common node and the second voltage reference node is maintained regardless of how many of the plurality of current source paths are selectively actuated by the high side driver.

2. The drive circuit of claim 1, wherein the low side driver comprises: a logic circuit configured to logically combine the first control signals with an enable signal to generate the second control signals.

3. The drive circuit of claim 1, wherein each sink path of said plurality of selectively actuated current sink paths has a substantially equal resistance between the common node and the second voltage reference node.

4. The drive circuit of claim 1, wherein a number of current sink paths that are selectively actuated equals a number of current source paths that are selectively actuated, regardless of how many of the plurality of current source paths are selectively actuated by the high side driver.

5. The drive circuit of claim 1, each sink path of said plurality of selectively actuated current sink paths comprises a transistor having a control terminal coupled to receive one of the second control signals.

6. The drive circuit of claim 5, each source path of said plurality of selectively actuated current source paths comprises a transistor having a control terminal coupled to receive one of the first control signals.

7. The drive circuit of claim 6, wherein each of the transistors for the sink paths has a substantially equal turn on drain-to-source resistance.

8. The drive circuit of claim 6, further comprising an LED connected in series with each of the transistors for the source paths.

9. A drive circuit, comprising:

a low side driver operable responsive to first control signals to selectively actuate certain ones of a plurality of current sink paths coupled in parallel between a first voltage reference node and a common node; and a high side driver operable responsive to second control signals to selectively actuate certain ones of a plurality of current source paths coupled in parallel between the common node and a second voltage reference node;

wherein said second control signals are generated in response to said first control signals so that a constant voltage drop between the common node and the second voltage reference node is maintained regardless of how many of the plurality of current sink paths are selectively actuated by the low side driver.

10. The drive circuit of claim 9, wherein the high side driver comprises: a logic circuit configured to logically combine the first control signals with an enable signal to generate the second control signals.

11. The drive circuit of claim 9, wherein each source path of said plurality of selectively actuated current source paths has a substantially equal resistance between the common node and the second voltage reference node.

12. The drive circuit of claim 9, wherein a number of current source paths that are selectively actuated equals a number of current sink paths that are selectively actuated, regardless of how many of the plurality of current sink paths are selectively actuated by the low side driver.

13. The drive circuit of claim 9, each source path of said plurality of selectively actuated current source paths comprises a transistor having a control terminal coupled to receive one of the second control signals.

14. The drive circuit of claim 13, each sink path of said plurality of selectively actuated current sink paths comprises a transistor having a control terminal coupled to receive one of the first control signals.

15. The drive circuit of claim 14, wherein each of the transistors for the source paths has a substantially equal turn on drain-to-source resistance.

16. The drive circuit of claim 13, further comprising an LED connected in series with each of the transistors for the sink paths.

17. A drive circuit, comprising:

a high side driver operable to selectively supply current to a plurality of resistive paths coupled in parallel with each other between a first voltage supply node and a common node;

a low side driver operable to sink current from the common node through a plurality of selectively actuated current sink paths coupled in parallel with each other between the common node and a second voltage supply node; and a control circuit operable to actuate plural ones of the selectively actuated current sink paths equal in number to the plurality of resistive paths which are selectively supplied current by the high side driver.

18. The drive circuit of claim 17, wherein said control circuit selectively actuates current source paths so that a constant voltage drop from the common node to the second voltage reference node is maintained regardless of how many of the resistive paths are selectively supplied current by the high side driver.

19. A drive circuit, comprising:

a low side driver operable to selectively sink current from a plurality of resistive paths coupled in parallel with each other between a first voltage supply node and a common node;

a high side driver operable to source current to the common node through a plurality of selectively actuated current source paths coupled in parallel with each other between the common node and a second voltage supply node; and a control circuit operable to actuate plural ones of the selectively actuated current source paths equal in number to the plurality of resistive paths from which current is selectively sunk by the low side driver.

20. The drive circuit of claim 19, wherein said control circuit selectively actuates current sink paths so that a constant voltage drop from the common node to the second voltage reference node is maintained regardless of how many of the resistive paths are selectively supplied current by the low side driver.

* * * * *